US009353499B2

(12) United States Patent
Azzolin et al.

(10) Patent No.: US 9,353,499 B2
(45) Date of Patent: May 31, 2016

(54) BUCKET FOR SCREENING AND CRUSHING INERT MATERIAL HAVING A BALANCING VALVE

(71) Applicant: MECCANICA BREGANZESE S.p.A. in breve MB S.p.A., Fara Vicentino (VI) (IT)

(72) Inventors: Guido Azzolin, Breganze (IT); Diego Azzolin, Breganze (IT)

(73) Assignee: MECCANICA BREGANZESE S.P.A. IN BREVE MB S.P.A., Fara Vicentino (VI) (IT)

( * ) Notice: Subject to any disclaimer, the term of this patent is extended or adjusted under 35 U.S.C. 154(b) by 114 days.

(21) Appl. No.: 14/348,635

(22) PCT Filed: Sep. 28, 2012

(86) PCT No.: PCT/IB2012/055190

§ 371 (c)(1),
(2) Date: Mar. 31, 2014

(87) PCT Pub. No.: WO2013/046168

PCT Pub. Date: Apr. 4, 2013

(65) Prior Publication Data

US 2014/0366407 A1 Dec. 18, 2014

(30) Foreign Application Priority Data

Sep. 30, 2011 (IT) ..... PD2011A0310

(51) Int. Cl.

| | |
|---|---|
| ***E02F 3/407*** | (2006.01) |
| ***E02F 7/06*** | (2006.01) |
| ***E02F 3/40*** | (2006.01) |

(Continued)

(52) U.S. Cl.
CPC . *E02F 3/40* (2013.01); *E02F 3/407* (2013.01); *E02F 3/965* (2013.01); *E02F 7/06* (2013.01); *E02F 9/2221* (2013.01)

(58) Field of Classification Search
USPC ..... 37/403, 444; 241/81
IPC ..... E02F 3/407,3/96, 7/06
See application file for complete search history.

(56) References Cited

U.S. PATENT DOCUMENTS

| | | | | |
|---|---|---|---|---|
| 6,871,807 | B2 * | 3/2005 | Rossi, Jr. | 241/101.72 |
| 7,222,444 | B2 * | 5/2007 | Hendron et al. | 37/348 |
| 7,222,807 | B2 * | 5/2007 | Azzolin | 241/201 |

(Continued)

FOREIGN PATENT DOCUMENTS

| | | | |
|---|---|---|---|
| DE | 10311918 | A1 | 10/2004 |
| EP | 1177839 | A1 | 2/2002 |
| WO | 2006105864 | A1 | 10/2006 |

OTHER PUBLICATIONS

ISR and Written Opinion for PCT/IB2012/055190 dated Feb. 6, 2013.

*Primary Examiner* — Gary Hartmann
(74) *Attorney, Agent, or Firm* — Kristina Castellano; Castellano PLLC

(57) ABSTRACT

A bucket (100) for screening and crushing inert material comprises an outer casing (1), a screening device (2) for screening the material which has to be crushed, a crushing unit (3) located in said casing (1) to crush the material and a detecting device (44) for detecting the angle of orientation (w) of the bucket (100) with respect to a reference surface (S), in which the screening device (2) and the crushing unit (3) are selectively operated, individually or in combination, according to the angle of orientation (w) of the bucket (100).

18 Claims, 2 Drawing Sheets

(51) Int. Cl.
*E02F 3/96* (2006.01)
*E02F 9/22* (2006.01)

(56) References Cited

U.S. PATENT DOCUMENTS 7,913,430 B2 * 3/2011 Mannikko ..... 37/403
8,011,607 B1 * 9/2011 Rossi, Jr. ..... 241/69
8,360,249 B1 * 1/2013 Currey ..... 209/671
8,678,195 B2 * 3/2014 Azzolin et al. ..... 209/235
2002/0189140 A1 * 12/2002 Stehr ..... 37/466
2004/0050985 A1 * 3/2004 Rossi, Jr. ..... 241/101.72
2006/0096137 A1 5/2006 Hendron et al.
2014/0231561 A1 * 8/2014 Azzolin et al. ..... 241/81
2014/0326816 A1 * 11/2014 Azzolin et al. ..... 241/81

* cited by examiner

BUCKET FOR SCREENING AND CRUSHING INERT MATERIAL HAVING A BALANCING VALVE

CLAIM FOR PRIORITY

This application is a U.S. National Stage Application of PCT/IB2012/055190 filed on Sep. 28, 2012, which claims priority to Italian application number PD 2011A000310 filed Sep. 30, 2011, the contents of both of which are incorporated herein by reference.

This invention relates to a bucket for screening and crushing inert material of the type comprising the characteristics mentioned in the precharacterising clause of the principal claim.

BACKGROUND OF THE INVENTION

In the technical context in question buckets that can be fitted on the end of an arm of an operating machine, comprising an outer casing configured for the collection of inert material such as gravel, material resulting from the demolition of buildings, within which members for crushing the material collected is mounted, are known.

One example of this type of bucket is described in European Patent EP 1532321, in which the bucket is spoon-shaped and the crushing members take the form of a pair of jaws which act with an alternating movement on the material to be crushed.

In these buckets an opening is normally provided for the material to be crushed, into which the material is inserted by causing the bucket to act as a gathering shovel through suitable movement of the arm of the operating machine.

From International Patent Application WO 2006105864 it is also known that screening devices can additionally be provided on the outer casing at the entrance to the bucket in addition to the crushing members.

The screening devices take the form of a perforated plate which forms the bottom of the opening through which the material being crushed enters and on which the material is spread out after it has been gathered. The plate is associated with a vibrating system to cause it to vibrate and allow material of small size to fall through.

After the initial screening the bucket is raised, allowing the material to fall into the crushing zone in a manner which is conceptually similar to that of other known buckets.

This combined screening and crushing system requires two different motor units to operate it, with little optimisation from the energy point of view, and in any event it is not very practical for the operator of the operating machine who has to control movement of the excavator arm and the corresponding two controls for activating the motor units at the same time. In addition to this the stages of screening and crushing, one after the other, are not in any way coordinated during operation of the bucket, thus making this solution of little practicality in use, and in fact causing it to be difficult to apply on an industrial level.

BRIEF SUMMARY OF THE INVENTION

Thus the technical problem underlying this invention is that of providing a bucket for crushing and crushing the inert material which makes it possible to overcome the abovementioned disadvantages in relation to the known art.

This problem is solved through a bucket according to the present invention.

This invention has a number of significant advantages. The main advantage lies in the fact that the bucket according to this invention is able to carry out screening and crushing in a single bucket, optimising energy consumption and coordinating the two operations in a precise and reliable way.

BRIEF DESCRIPTION OF THE DRAWINGS

Other advantages, features and methods of use of this invention will be apparent from the following detailed description of a number of embodiments provided by way of example and without limitation. Reference will be made to the figures in the appended drawings, in which.

DETAILED DESCRIPTION

Figures 1, 1A, 1B:
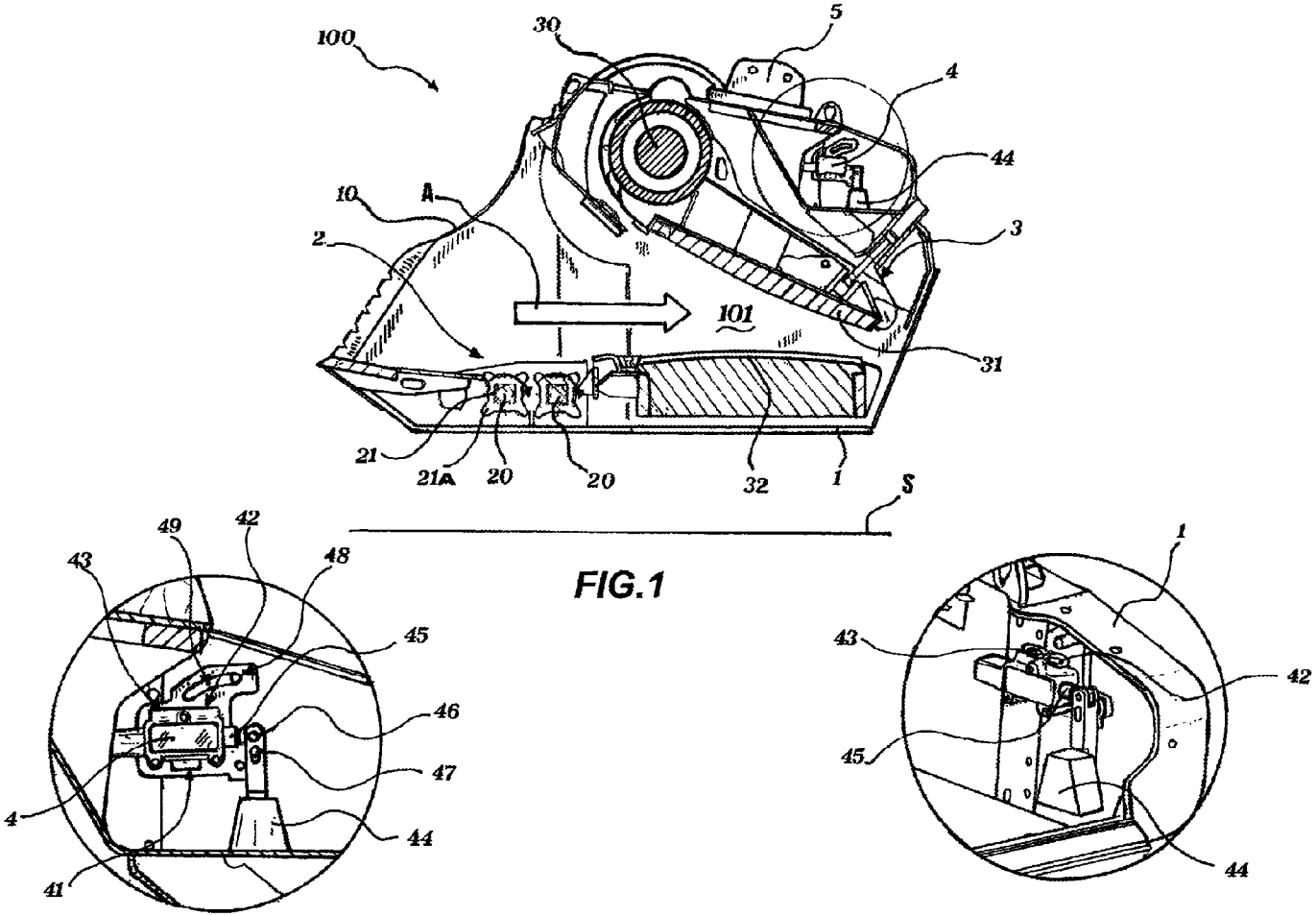
FIG. 1 is a side view in cross-section of a bucket according to this invention in a first operating configuration.
FIGS. 1A and 1B are respectively a side view in cross-section and a perspective view in cross-section of a three-way hydraulic valve, a detail of the bucket in FIG. 1, in the first operating configuration.

With reference initially to FIG. 1, a bucket for the crushing of inert material, such as for example waste material originating from the demolition of structures or excavations, is indicated as a whole by reference number 100. This bucket is of a type which is suitable for mounting on a moving arm of an operating machine, not illustrated in the figure, through a connecting plate 5 or other equivalent attachment members.

Bucket 100 comprises an outer casing 1 within which is located a crushing unit 3, illustrated diagrammatically.

Crushing unit 3 is located within a channel 101 along which the material which is to be crushed advances along a defined direction of advance A, substantially parallel to the longitudinal direction of the bucket.

Figure 2:
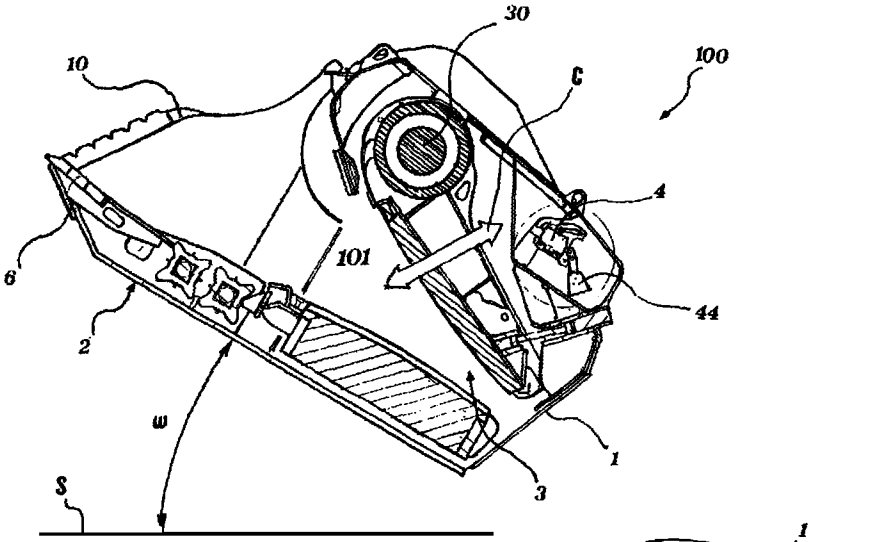
FIG. 2 is a side view in cross-section of the bucket according to this invention in the second operating configuration.
Figure 2B:
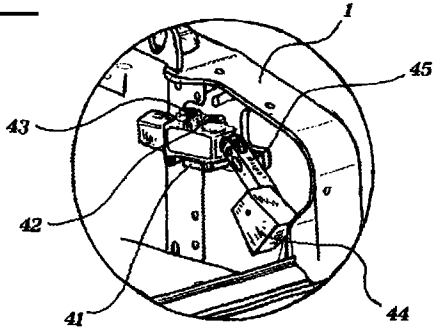
FIGS. 2A and 2B are respectively a side view in cross-section and a perspective view in cross-section of the three-way hydraulic valve, a detail of the bucket in FIG. 2, in the second operating configuration.
Figure 2A:
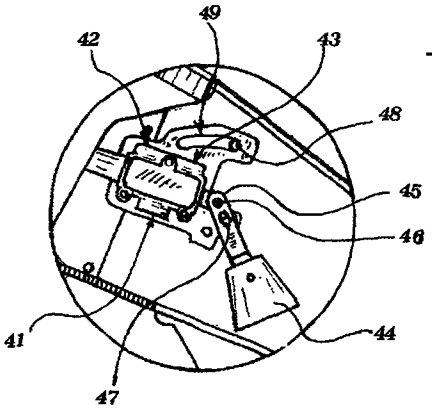

Furthermore, according to a preferred embodiment, crushing unit 3 is of the jaw type, and comprises at least one moving jaw 31, preferably associated with a fixed jaw 32, which moves in alternating motion along a crushing direction C perpendicular to the direction A of advance of the material, as illustrated in FIG. 2.

Moreover the movement of jaw 31 may be a combined movement, with a component in direction C and a component parallel to the direction of advance A. It is also obvious that crushing may be achieved through other crushing units or devices, such as for example roller systems. These solutions are however known to those skilled in the art and as a consequence will not be described in greater detail below.

It will also be noted that in this embodiment channel 101 has a transverse cross-section of substantially rectangular shape, such as to allow jaw 31 to move within it.

In bucket 100 there is an entrance section 10 allowing material to be crushed to enter outer casing 1, and a device 2 for screening the material which has to be crushed is provided in an intermediate position between entrance section 10 and crushing unit 3. The casing also comprises a shovel appendage 42 located upstream of screening device 2 in relation to direction of advance A through which gathering of the material to be crushed from the ground, or more generally from any working surface, can be improved.

In greater detail, screening device 2 comprises at least one rotating member 20 and in the present embodiment this rotating member 20 rotates about an axis Y which is substantially perpendicular to direction A along which the material advances towards crushing unit 3, as illustrated in FIG. 2.

In greater detail, screening device 2 comprises a pair of rotating members, rotating in a concordant direction, and supported by casing 1 in a position adjacent to an entrance opening 11 in the casing which in this embodiment coincides with entrance section 10.

Each rotating member 20 is in the form of a shaft and supports a plurality of discs 21, which also have axes parallel to axis of rotation Y.

The rotating members are spaced apart and are at a distance from the respective edges of the bottom of channel 101, these edges being adjacent to the rotating members in such a way as to define sufficient space for the passage of material which does not need to be crushed.

In particular, through rotation of the rotating members and in particular their position on the casing it is possible to screen a portion of the material to be crushed that is smaller than a predetermined size, which because of its nature does not need to be crushed, while also allowing a portion of the material to be crushed which is larger than that predetermined size to advance towards crushing unit 3.

As will in any event be better illustrated below, screening device 2 may also be of a different type, for example comprising a screening basket rotatably connected to the casing and rotating about an axis parallel to the direction of advance A, or yet again a vibrating plate located upstream of the crushing unit.

In a manner which is conceptually similar to that of buckets constructed according to the known art, operation of the bucket according to this invention provides for a first stage of collection in which the bucket operates as a shovel, gathering material which has to be crushed from the ground. After being collected, the material to be crushed is screened through device 2, prior to subsequent crushing. In fact one of the purposes of the screening is to prevent sandy materials and materials of a size not requiring crushing in crushing unit 3 from being present.

In this screening stage, bucket 100 is located in the operating condition in FIG. 1, that is in a position substantially parallel to the ground, which thereby defines a reference surface S for angular orientation of the bucket. Typically the screening stage lasts a few seconds and after this initial screening the operator tips the bucket upwards in order to bring it into the operating configuration described in FIG. 2 in which the bucket is inclined at an angle ω relative to reference surface S.

In this configuration the material present in channel 101 is delivered through gravity to crushing unit 3 which crushes the material already screened by device 2.

It will therefore be noted that the crushing unit does not need to be in operation during screening, and vice versa screening of the material is not required during crushing, except in respect of that part of the material which still remains adjacent to the screening device when the bucket is raised.

In order to optimise passage between the two operations the bucket according to this invention comprises a device 44 for detecting an angle of orientation ω of bucket 100 with respect to reference surface S which therefore makes it possible to identify the operating configuration of the buckets.

In this way it becomes possible to selectively operate screening device 2 or crushing unit 3 in relation to the angle of orientation ω of bucket 100 detected by detecting device 44.

According to a preferred embodiment the bucket also comprises a switching device 4 which makes it possible to switch between operation of screening device 2 and operation of crushing units 3 in relation to angle of orientation ω.

In particular the switching device is such that when bucket 100 is parallel to reference surface S, on the basis of what has been detected by the device detecting angle ω, only screening device 2 is operated, while crushing unit 3 is instead not in operation. Vice versa, when bucket 100 is inclined with respect to reference surface S at more than a limit angle $\omega_{lim}$, again detected by the detecting device mentioned above, the switching device will switch operation of the bucket in such a way that only crushing unit 3 is operated, with screening device 2 not in operation.

In addition to this, it is provided that switching device 4 performs gradual switching between the operation of screening device 2 and that of crushing unit 3. In this way, when bucket 100 is in an intermediate position between the position parallel to reference surface S and limit angle $\omega_{lim}$ screening device 2 and crushing unit 3 are both at least partly in operation.

As a consequence, when bucket 100 is raised, rotation of rotating members 20 of screening device 2 is reduced and crushing unit 3 is partly operated until such time as the screening device comes to a complete stop crushing unit 3 is fully operating. In this way it is possible to envisage situations in which screening device 2 continues the screening operation, although with less vigour, even while the crushing unit is in operation.

This method of operation may advantageously be implemented by activating both the screening device and the crushing unit via a hydraulic circuit.

Furthermore, the actuators for screening device 2 and crushing unit 3 will preferably be fed from a single flow of oil or other operating fluid provided by the operating machine.

As a consequence the flow of operating fluid will be directed to screening device 2 or crushing unit 3 according to orientation angle ω.

According to a preferred embodiment, the switching device and the detecting device will be of the mechanical type, comprising a three-way hydraulic valve 4 equipped with a movable switching shutter 45, associated with a counterweight 44, tilting in relation to angle ω, forming the detecting device mentioned above. As a consequence it will be noted that in this case the switching device and the detecting device are provided through a single device, defined by valve 4 and its corresponding counterweight.

In greater detail, three-way hydraulic valve 4 includes an inlet 41 for the operating fluid, a first outlet 42 connected to the drive for screening device 2 and a second outlet 43 which is instead connected to the drive for said crushing unit 3. In particular, in this embodiment, the operating fluid feeds the corresponding hydraulic motors of the screening device and the crushing unit.

Moving shutter 45 thus makes it possible to select first outlet 42, second outlet 43 or to distribute the flow of oil between the two outlets according to its relative position with respect to valve body 4.

Counterweight 44 is hinged at one extremity 46 of shutter 45 and swings around a pin 47 forming part of casing 1. In this way rotation of casing 1 brought about by movement of the bucket causes a consequent displacement of shutter 45, switching operation of the valve between first outlet 42 and second outlet 43.

In particular counterweight 44 behaves as a connecting rod and its rotational movement is converted into straight line motion of shutter 45, which acts like a piston. Counterweight 44 is also constructed in such a way that the force of gravity tends to hold the connecting rod, defined by a longitudinal direction of the counterweight or, alternatively, the straight line connecting the centre of rotation between shutter 45 and counterweight 44 and the centre of rotation of the counterweight on pin 47, in a position perpendicular with respect to the ground and therefore with respect to reference surface S, regardless of the orientation of the bucket.

In accordance with a preferred embodiment valve 4 may be in turn orientatable with respect to casing 1, and may also rotate about an axis of rotation perpendicular to direction of advance A and parallel to the axis of rotation defined by angle ω. In particular valve 4 comprises a slot 49 defining an arc of circumference which slides on a pin 48 forming part of casing 1. Through this movement it is possible to alter the orientation of valve 4 with respect to casing 1, thus making it possible to delay or advance switching between a first or second outlet of the valve through a particularly simple solution from the construction point of view. In fact, as illustrated above, the valve switches the outlet according to the orientation of the bucket, and by imposing a relative angle between the valve and the bucket it is possible to achieve this effect.

The invention therefore solves the problem stated, at the same time offering a plurality of advantages, including better management of the different operating stages of screening and crushing and a saving in terms of energy consumption. In particular, the possibility of delivering a flow of oil selectively to the rotating member or the crushing units makes it possible to reduce the flow of oil required for operation of the bucket.

In any event it is obvious that electronic systems incorporating a digital angular sensor associated with an electrically operated valve or other switching devices of the electrical or electronic type may be used as an alternative to the mechanical system described. In this case operation of the system may be entrusted to an electronic control unit which controls the stages of screening and crushing on the basis of data detected by the angular sensor in a way which is conceptually similar to that which has been is described above.

The invention claimed is:

1. A bucket for screening and crushing inert material comprising an outer casing, a screening device for screening the material to be crushed and a crushing unit arranged in the casing for crushing the material, comprising a detecting device for detecting an angle of orientation (ω) of the bucket with respect to a reference surface (S), wherein the screening device and the crushing unit are selectively brought into operation, singly or in combination, according to the angle of orientation (ω) of the bucket.

2. The bucket according to claim 1, comprising a switching device for operating the drive of the screening device and of the crushing unit, the switching device being such that when the bucket is parallel to the reference surface (S) only the screening device is operated, the crushing unit not being in operation, and when the bucket (100) is inclined with respect to the reference surface (S) by more than a predetermined limit angle ($\omega_{lim}$) only the crushing unit (3) is operated, the screening device not being in operation.

3. The bucket according to claim 2, wherein the switching device is suitable for gradually switching the drive of the screening device and the crushing units in such a way that when the bucket is in a position intermediate between the position parallel to the reference surface (S) and the limit angle ($\omega_{lim}$) the screening device and the crushing unit are both at least partially in operation.

4. The bucket according to claim 1, wherein said screening device comprises a rotating member rotatably connected to the casing.

5. The bucket according to claim 1, wherein said crushing unit comprises at least one movable jaw the alternating motion of which is obtained by a rotating shaft with which said jaw is associated.

6. The bucket according to claim 1, wherein the screening device and the crushing unit comprise a respective hydraulic type drive fed by a single flow of operating fluid which is delivered to the screening device and/or to the crushing unit according to said angle of orientation (ω).

7. The bucket according to claim 4, wherein rotation of the rotating member and of the shaft is effected by hydraulic motors fed by said single flow of operating fluid.

8. The bucket according to claim 2, wherein the screening device and the crushing unit comprise a respective hydraulic type drive fed by a single flow of operating fluid which is delivered to the screening device and/or to the crushing unit according to said angle of orientation (ω); and wherein the switching device comprises a three-way hydraulic valve, which includes an inlet for the operating fluid, a first outlet connected to the drive of the screening device and a second outlet connected to the drive of the crushing unit, the first and the second outlet being capable of being selected according to said angle of orientation (ω).

9. The bucket according to claim 8, wherein said valve has a movable shutter for selecting the first outlet and/or the second outlet, the shutter being associated with a counterweight hinged to one end of the shutter and pivoting about a pin forming part of the casing, in such a way that the rotation of the casing produces a consequent displacement of the shutter, switching the operation of the valve between the first outlet and the second outlet.

10. The bucket according to claim 8, wherein the valve can be oriented with respect to the casing, being rotatable about an axis of rotation parallel to an axis of rotation defined by the angle (ω).

11. The bucket according to claim 9, wherein the valve comprises a slot which defines an arc of a circumference and is suitable for sliding on a pin forming part of the casing.

12. The bucket according to claim 1, wherein the screening device is in the form of a basket of frustoconical shape rotatable about an axis parallel to a feed direction (A) for the material to be crushed.

13. The bucket according to claim 1, comprising attachment members for attachment to a free end of an arm of an operating machine.

14. An operating machine comprising a bucket according to claim 1.

15. The bucket according to claim 2 wherein said screening device comprises a rotating member rotatably connected to the casing;

wherein rotation of the rotating member and of the shaft is effected by hydraulic motors fed by said single flow of operating fluid; and wherein the switching device comprise a three-way hydraulic valve, which includes an inlet for the operating fluid, a first outlet connected to the drive of the screening device and a second outlet connected to the drive of the crushing unit, the first and the second outlet being capable of being selected according to said angle of orientation (ω).

16. The bucket according to claim 15, wherein said valve has a movable shutter for selecting the first outlet and/or the second outlet, the shutter being associated with a counterweight hinged to one end of the shutter and pivoting about a pin forming part of the casing, in such a way that the rotation of the casing produces a consequent displacement of the shutter, switching the operation of the valve between the first outlet and the second outlet.

17. The bucket according to claim 15, wherein the valve can be oriented with respect to the casing, being rotatable about an axis of rotation parallel to an axis of rotation defined by the angle (ω).

18. The bucket according to claim 16, wherein the valve comprises a slot which defines an arc of a circumference and is suitable for sliding on a pin forming part of the casing.

* * * * *